US009411306B2

(12) United States Patent
Yoo et al.

(10) Patent No.: US 9,411,306 B2
(45) Date of Patent: Aug. 9, 2016

(54) IMAGE FORMING APPARATUS AND MAINTENANCE METHOD THEREOF

(71) Applicant: Samsung Electronics Co., Ltd, Suwon-si, Gyeonggi-do (KR)

(72) Inventors: Dae-hyung Yoo, Seoul (KY); Jin-ho Park, Yongin-si (KR); Han-jun Lee, Goyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/478,205

(22) Filed: Sep. 5, 2014

(65) Prior Publication Data

US 2015/0117899 A1 Apr. 30, 2015

(30) Foreign Application Priority Data

Oct. 25, 2013 (KR) ..... 10-2013-0127666

(51) Int. Cl.

*G03G 21/12* (2006.01)
*G03G 21/16* (2006.01)
*G03G 21/18* (2006.01)

(52) U.S. Cl.

CPC ..... *G03G 21/1676* (2013.01); *G03G 21/12* (2013.01); *G03G 21/1647* (2013.01); *G03G 21/1671* (2013.01); *G03G 21/1821* (2013.01)

(58) Field of Classification Search

CPC ..... G03G 21/12; G03G 21/1647; G03G 21/1676; G03G 21/1671; G03G 21/1821

See application file for complete search history.

(56) References Cited

U.S. PATENT DOCUMENTS

| | | | | |
|---|---|---|---|---|
| 8,594,529 | B2 | 11/2013 | Jeong | |
| 2007/0189804 | A1* | 8/2007 | Yasumitsu | 399/111 |
| 2008/0069593 | A1 | 3/2008 | Nishiyama | |
| 2009/0010677 | A1* | 1/2009 | Yang | 399/110 |
| 2009/0214269 | A1 | 8/2009 | Choi et al. | |
| 2010/0142994 | A1* | 6/2010 | Kinoshita | 399/111 |

(Continued)

FOREIGN PATENT DOCUMENTS

| | | |
|---|---|---|
| EP | 0608812 | 8/1994 |
| EP | 2261756 | 12/2010 |

(Continued)

OTHER PUBLICATIONS

PCT Search Report and Written Opinion dated Dec. 30, 2014 from International Patent Application No. PCT/KR2014/008645.

(Continued)

*Primary Examiner* — Sandra Brase
(74) *Attorney, Agent, or Firm* — Staas & Halsey LLP

(57) ABSTRACT

An image forming apparatus includes a main body frame, an image forming unit disposed in the main body frame and comprising an image carrier and a developing member, a gap control unit to selectively allow the image carrier to be in contact with or spaced apart from the developing member, a lever member disposed at one end of the gap control unit to operate the gap control unit to be moved between a contact position where the image carrier contacts the developing member and a separation position where the image carrier is spaced apart from the developing member, and a waste developer receptacle detachably disposed in the main body frame and having a lever member receiving groove to receive the lever member, wherein if the waste developer receptacle is removed from the main body frame, the image carrier is spaced apart from the developing member.

31 Claims, 17 Drawing Sheets

(56) References Cited

U.S. PATENT DOCUMENTS

| | | | | |
|---|---|---|---|---|
| 2010/0316409 | A1* | 12/2010 | Ji et al. | 399/111 |
| 2012/0087699 | A1 | 4/2012 | Wu et al. | |
| 2012/0163858 | A1 | 6/2012 | Fujii et al. | |
| 2013/0071165 | A1 | 3/2013 | Kitamura | |

FOREIGN PATENT DOCUMENTS

| | | |
|---|---|---|
| EP | 2280315 | 2/2011 |
| JP | 2002-169441 | 6/2002 |
| JP | 2006-308799 | 11/2006 |
| JP | 2012-58627 | 3/2012 |
| KR | 10-2011-0068448 | 6/2011 |
| KR | 10-2012-0075370 | 7/2012 |

OTHER PUBLICATIONS

Extended European Search Report dated Apr. 15, 2015 in European Patent Application No. 14188901.4.

* cited by examiner

IMAGE FORMING APPARATUS AND MAINTENANCE METHOD THEREOF

CROSS-REFERENCE TO RELATED APPLICATIONS

This application claims priority under 35 U.S.C. §119(a) from Korean Patent Application No. 10-2013-0127666 filed Oct. 25, 2013 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to an image forming apparatus including an image forming unit in which a developing member and an image carrier are selectively in contact with or spaced apart from each other and a maintenance method of the image forming apparatus.

2. Description of the Related Art

Generally, a photographing unit including an image carrier and a developing unit including a developing member that are used in an electro-photographic image forming apparatus are components having a certain lifetime so that they may need to be replaced with new units after a certain number of print media are printed.

For this, the photographing unit and the developing unit are detachably disposed in a main body frame of the image forming apparatus, and the photographing unit and the developing unit are hinge-connected to be rotated by a predetermined angle with respect to each other so that the image carrier of the photographing unit and the developing member of the developing unit may be selectively in contact with or spaced apart from each other. To rotate the developing unit a predetermined angle with respect to the photographing unit is performed by a contact-separating unit which is separately disposed. A lever member is disposed at one end of the contact-separating unit, and, if the user rotates the lever member, the developing unit is rotated by a predetermined angle with respect to the photographing unit so that the developing member is in contact with or spaced apart from the image carrier.

In a case of assembly of a conventional image forming apparatus, after a photographing unit 201 and a developing unit 203 are mounted, as illustrated in FIG. 1, if a lever member 210 is rotated upward (in a direction of an arrow AA illustrated in FIG. 1), a developing member 204 is brought into contact with an image carrier 202 (i.e. the developing member 204 is moved in a direction of an arrow BB in FIG. 1). Accordingly, the image forming apparatus is normally operated to perform printing.

However, since the conventional image forming apparatus is not configured to automatically confirm whether the developing member 204 is in contact with or spaced apart from the image carrier 202, the user needs to visually check whether the developing member 204 is in contact with the image carrier 202 or not. If the user operates the image forming apparatus in a state in which the lever member 210 is not rotated, that is, in a state in which the developing member 204 is not contact with the image carrier 202, then because the developing member 204 is not contact with the image carrier 202, an image is not formed.

Also, in a case in which the photographing unit 201 or the developing unit 203 needs to be replaced for maintenance of the image forming apparatus, the lever member 210 of FIG. 1 should be rotated downward. Then, the developing member 204 is spaced apart from the image carrier 202 so that the developing unit 203 and the photographing unit 201 may be separated. If the user separates the photographing unit 201 and developing unit 203 in a state in which the lever member 210 is not rotated downward (in a direction opposite arrow AA in FIG. 1), because the image carrier 202 and the developing member 204 are in contact with each other, the photographing unit 201 and the developing unit 203 may be damaged. For example, if the photographing unit 201 is forcibly removed in a state in which the developing member 204 is in contact with the image carrier 202, contact regions of the developing member 204 and the image carrier 202 are severely rubbed against each other so that the surface of the image carrier 202 may be damaged.

However, since the conventional image forming apparatus is configured so that the user manually rotates the lever member 210 to allow the image carrier 202 to be in contact with or to be separated from the developing member 204, the user may forget to rotate the lever 210 member. If the photographing unit 201 or the developing unit 203 is separated in a state in which the lever member 210 is not rotated, the image carrier 202 is rubbed against the developing member 204 and may be damaged. Further, after the photographing unit 201 and the developing unit 203 are mounted, if the image forming apparatus is operated in a state in which the lever member 210 is not rotated, the developing member 204 is not in contact with the image carrier 202 so that normal printing may not be performed.

Accordingly, it is necessary to provide an image forming apparatus that can prevent problems caused by a user forgetting to rotate the lever member 210.

SUMMARY OF THE INVENTION

The present general inventive concept provides an image forming apparatus configured so that, when separation of a photographing unit and a developing unit is required, an image carrier and a developing member are automatically spaced apart from each other, and, after the photographing unit and the developing unit are mounted, a waste developer receptacle may not be mounted if the developing member and the image carrier are not in contact with each other, and a maintenance method of the image forming apparatus.

Additional features and utilities of the present general inventive concept will be set forth in part in the description which follows and, in part, will be obvious from the description, or may be learned by practice of the general inventive concept.

Exemplary embodiments of the present general inventive concept provide an image forming apparatus, including a main body frame, an image forming unit disposed in the main body frame and including an image carrier and a developing member, a gap control unit configured to selectively allow the image carrier and the developing member to be in contact with or to be spaced apart from each other, a lever member disposed at one end of the gap control unit to operate the gap control unit, the lever member configured to be moved between a contact position in which the gap control unit is operated so that the image carrier and the developing member are in contact with each other and a separation position in which the gap control unit is operated so that the image carrier and the developing member are spaced apart from each other, and a waste developer receptacle detachably disposed in the main body frame, the waste developer receptacle provided with a lever member receiving groove that can receive the lever member when the lever member is in the contact position, wherein if the waste developer receptacle is removed from the main body frame, the image carrier and the developing member are spaced apart from each other by the gap control unit.

The lever member receiving groove of the waste developer receptacle may include a lever member operating rib to press the lever member towards the separation position.

The lever member receiving groove of the waste developer receptacle may further include a stopper to limit rotation of the lever member by the lever member operating rib.

The lever member operating rib may include an inclined surface to be in contact with the lever member.

The main body frame may include a mounting groove that is formed in a shape corresponding to the waste developer receptacle and in which the waste developer receptacle is detachably disposed. The lever member may be rotatably disposed on a bottom surface of the mounting groove.

When the lever member is placed in the separation position, the waste developer receptacle may not be mounted in the mounting groove.

The lever member may be formed in an L-shape, the lever member receiving groove of the waste developer receptacle may include a vertical groove and a horizontal groove that are formed in the L-shape to accommodate the lever member inserted therein, and a lever member operating rib configured to press the lever member towards the separation position may be provided on a top surface of the horizontal groove, and a bottom surface of the horizontal groove may be configured to limit rotation of the lever member by the lever member operating rib.

The gap control unit may be a link structure having at least two links.

The image forming unit may include a developing unit including the developing member, and a photographing unit that is hinge-connected to the developing unit and includes the image carrier. The gap control unit may include a pressing member disposed in the main body frame so that the pressing member can linearly move with respect to a lower portion of the developing unit, a link member having one end connected to the pressing member, a crank arm rotatably connected to other end of the link member, an elastic member disposed around the link member to elastically support the pressing member, and a rotation shaft that is connected to the crank arm, is rotatably disposed in the main body frame, and has one end being protruded in the mounting groove. The lever member may be connected to the one end of the rotation shaft that is protruded in the mounting groove.

The pressing member may include an elongate groove that is formed in a direction parallel to a moving direction of the pressing member, and a guide projection may be formed at one end of the link member, may be inserted in the elongate groove, and may be moved inside the elongate groove.

If the lever member is placed in the contact position, the elastic member may push the pressing member to allow the developing unit to be rotated by a predetermined angle so that the developing member is brought into contact with the image carrier, and if the lever member is placed in the separation position, a force with which the elastic member pushes the pressing member may be removed to allow the developing unit to be returned to an original position so that the developing member is spaced apart from the image carrier.

When the link member and the crank arm make a straight line, the elastic member may be compressed to a maximum.

A first stopper may be disposed in the main body frame and may be configured to limit rotational motion of the crank arm, and when the crank arm is in contact with the first stopper, the pressing member may press the developing unit by the elastic force of the elastic member so that the developing member is brought into contact with the image carrier.

When the lever member is in contact with a stopper of the waste developer receptacle, an angle between the crank arm and the link member may be the same as or similar to an angle between the crank arm and the link member when the crank arm is in contact with the first stopper.

Exemplary embodiments of the present general inventive concept also provide a maintenance method of an image forming apparatus, the method including separating a waste developer receptacle from a main body frame, allowing, if the waste developer receptacle is separated, a lever member to be automatically moved to a separation position so that a developing member of a developing unit is spaced apart from an image carrier of a photographing unit, allowing the lever member to be moved to a contact position so that the developing member of the developing unit is in contact with the image carrier of the photographing unit, mounting the waste developer receptacle in the main body frame in order for the lever member in the contact position to be inserted into a lever member receiving groove of the waste developer receptacle, and allowing, when the waste developer receptacle is mounted in the main body frame, a lever member operating rib of the lever member receiving groove to press the lever member towards the separation position so that the lever member is brought into contact with a stopper of the lever member receiving groove.

When the lever member is in contact with the stopper of the lever member receiving groove, a force that is applied to the developing unit may be the same as or similar to a force that is applied to the developing unit when the lever member is placed in the contact position.

If the waste developer receptacle is separated from the main body frame, the lever member may be moved to the separation position by an elastic force of a gap control unit pressing the developing unit so that the developing member of the developing unit is spaced apart from the image carrier of the photographing unit.

Exemplary embodiments of the present general inventive concept also provide an image forming apparatus including a gap control unit disposed to control a gap between an image carrier and a developing member, the gap control unit being configured to narrow the gap when disposed in a first position, and a lever member disposed to move the gap control unit to a second position opposite to the first position with respect to a reference line, according to a force transmitted from an external unit to the lever member when the external unit is installed in the image forming apparatus.

The external unit may be a waste developer receptacle.

The gap control unit may include an arm forming an angle with the reference line according to the position of the gap control unit.

The angle formed by the arm with the reference line may control the gap between the image carrier and the developing member.

The absolute value of the angle formed by the arm with the reference line when the gap control unit is in the first position may be approximately equal to the absolute value of the angle formed by the arm with the reference line when the gap control unit is in the second position.

The gap control unit may further include a link to form an angle with the arm, the angle between the arm and the link varying according to a movement of the lever member.

The angle between the arm and the link may control the gap between the image carrier and the developing member.

The absolute value of the angle between the arm and the link when the gap control unit is in the first position may be approximately equal to the absolute value of the angle between the arm and the link when the gap control unit is in the second position.

The link may include an elastic member to move the gap control unit according to the movement of the lever member.

The gap control unit may further include a shaft connected to the lever member at one end of the gap control unit, and a distance between the shaft and an opposite end of the gap control unit may control the gap between the image carrier and the developing member.

When the external unit is removed from the image forming apparatus, the gap control unit may move in a direction towards a third position. The gap control unit may be configured to widen the gap between the image carrier and the developing member when the gap control unit is moved towards the third position.

The lever member may move in the same direction when the gap control unit moves from the first position to the second position as when the gap control unit moves from the second position to the third position.

Exemplary embodiments of the present general inventive concept further provide a maintenance method of an image forming apparatus, the method including narrowing a gap between an image carrier and a developing member when a gap control unit is disposed in a first position, and using a lever member to move the gap control unit to a second position opposite to the first position with respect to a reference line, according to a force transmitted from an external unit to the lever member when the external unit is installed in the image forming apparatus.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
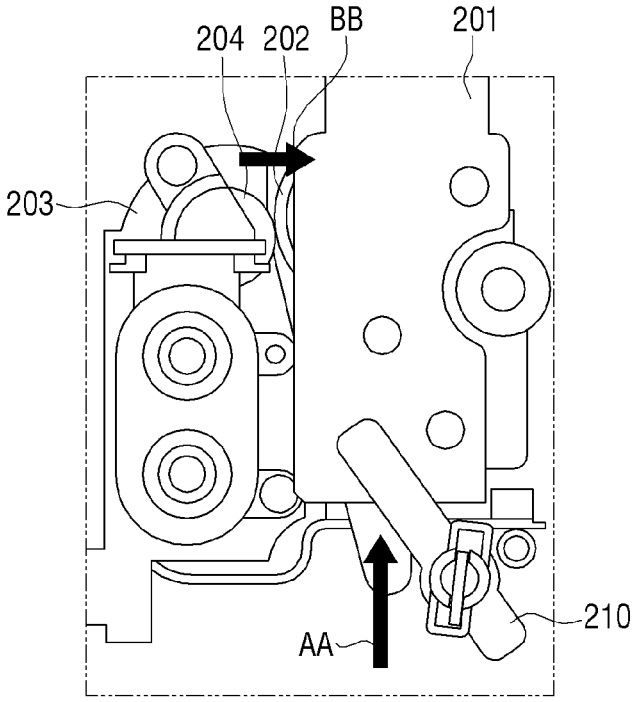
FIG. 1 (PRIOR ART)
FIG. 1 is a partial view illustrating a state in which a developing member is in contact with an image carrier in a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined herein, such as a detailed construction and elements thereof, are provided to assist in a comprehensive understanding of this description. Thus, it is apparent that exemplary embodiments of the present general inventive concept may be carried out without those defined matters. Also, well-known functions or constructions are omitted to provide a clear and concise description of exemplary embodiments of the present general inventive concept. Further, dimensions of various elements in the accompanying drawings may be arbitrarily increased or decreased to assist in a comprehensive understanding.

Figure 2:
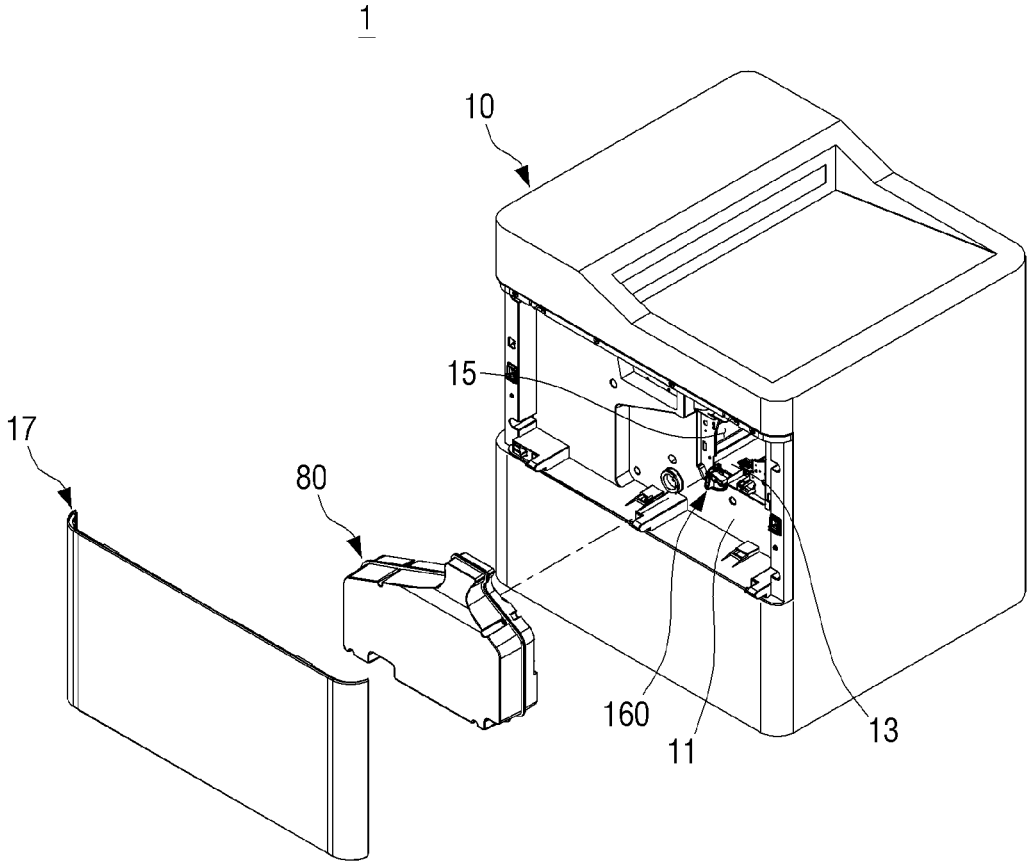
FIG. 2 is an exploded perspective view illustrating an image forming apparatus according to an embodiment of the present general inventive concept.
Figure 3:
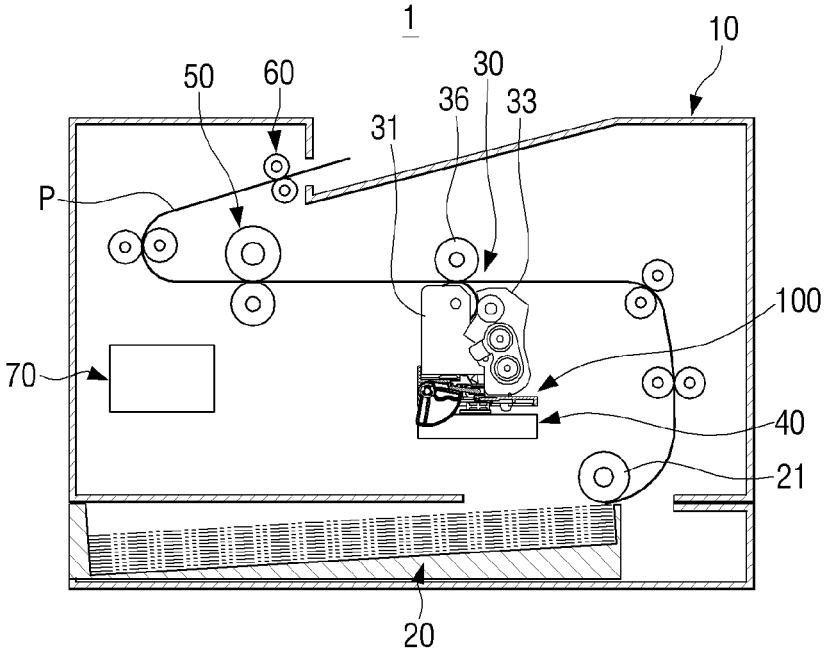
FIG. 3 is a cross-sectional view schematically illustrating a configuration of the image forming apparatus of FIG. 2.
Figure 4:
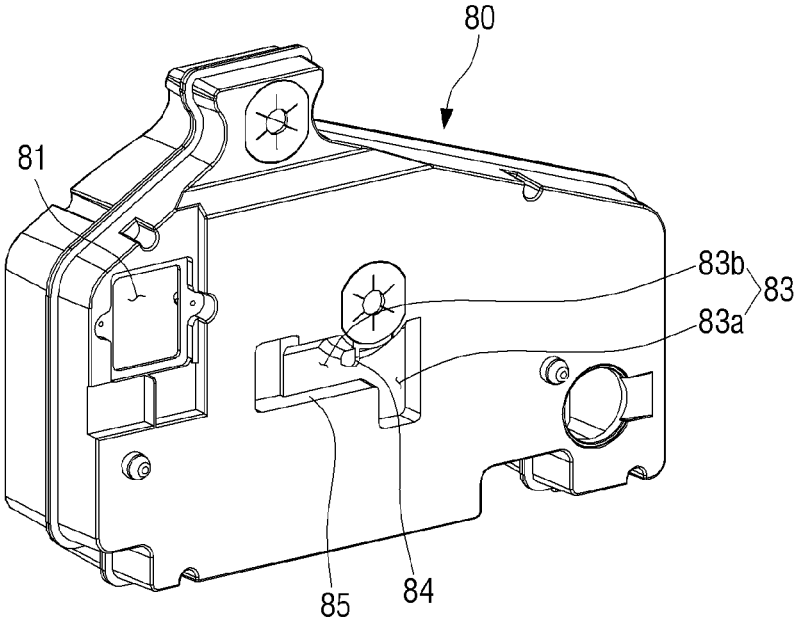
FIG. 4 is a perspective view illustrating a waste developer receptacle that is used in the image forming apparatus of FIG. 2.

FIG. 2 is an exploded perspective view illustrating an image forming apparatus 1 according to an exemplary embodiment of the present general inventive concept, and FIG. 3 is a cross-sectional view schematically illustrating a configuration of the image forming apparatus 1 of FIG. 2. FIG. 4 is a perspective view illustrating a waste developer receptacle 80 that is used in the image forming apparatus 1 of FIG. 2.

Referring to FIGS. 2 and 3, the image forming apparatus 1 according to an exemplary embodiment of the present general inventive concept includes a main body frame 10, a paper feeding unit 20, an image forming unit 30, an exposure unit 40, a fixing unit 50, a paper discharging unit 60, and a controller 70.

The paper feeding unit 20 stores a predetermined number of sheets of print media P, and feeds the print media P one by one. The paper feeding unit 20 includes a pickup roller 21 that picks up the print media P one by one and feeds it to the image forming unit 30.

The image forming unit 30 is to form a certain developer image on the print medium P fed from the paper feeding unit 20, and includes a photographing unit 31, a developing unit 33, and a gap control unit 100. The photographing unit 31 includes an image carrier 32 on which a predetermined electrostatic latent image is formed, and the developing unit 33 includes a developing member 34 to supply developer to the image carrier 32 to thereby form the certain developer image on the image carrier 32. The developer image formed on the image carrier 32 is transferred onto the print medium P by a transfer roller 36. The developing unit 33 is hinge-connected to the photographing unit 31 to be rotated by a predetermined angle on a hinge shaft 35 about the photographing unit 31. The photographing unit 31 and the developing unit 33 are detachably disposed in the main body frame 10.

The gap control unit 100 is disposed below the photographing unit 31, and is formed to selectively apply a force to at least one of the image carrier 32 and the developing member 34 to control a gap G (illustrated for example in FIGS. 8 and 12) between the image carrier 32 and the developing member 34. For the purposes of the exemplary embodiment of the present general inventive concept illustrated in the figures, the gap control unit 100 applies the force to a lower portion of the developing unit 33, and by extension the developing member 34. If the gap control unit 100 applies the force to the lower portion of the developing unit 33, the developing member 34 of the developing unit 33 is in contact with the image carrier 32 of the photographing unit 31. If the force being applied by the gap control unit 100 is removed, the developing unit 33 is rotated by a predetermined angle so that the developing member 34 is spaced apart from the image carrier 32. A gap maintaining member (not illustrated) is disposed between the developing unit 33 and the photographing unit 31 so that the developing member 34 is spaced apart from the image carrier 32. The gap maintaining member may be formed as an elastic member such as a spring. The gap control unit 100 may be formed as a link structure including at least two links. A detailed description about the structure of the gap control unit 100 will be described later with reference to FIGS. 7-12. When the gap control unit 100 does not apply a force to the developing unit 33, the developing unit 33 and the photographing unit 31 can be separated through an opening 15 that is formed in a side surface of the main body frame 10. The opening 15 may correspond to the shape of the waste developer receptacle 80.

The exposure unit 40 is disposed below the image forming unit 30, and forms electrostatic latent images corresponding to printing data that are transmitted from the controller 70 onto a surface of the image carrier 32.

The fixing unit 50 includes a pressure roller and a heating roller, and applies heat and pressure to the print medium P to allow the developer image transferred on the print medium P when passing through the image forming unit 30 to be fixed on the print medium P.

The paper discharging unit 60 discharges the print medium P on which fixing of the image is completed out of the main body frame 10.

The controller 70 receives the printing data from the outside, for example a computer (not illustrated) connected to the image forming apparatus 1. The controller then controls the paper feeding unit 20, the image forming unit 30, the exposure unit 40, the fixing unit 50, and the paper discharging unit 60 to form images corresponding to the received printing data on the print medium P.

The paper feeding unit 20, the exposure unit 40, the fixing unit 50, the paper discharging unit 60, and the controller 70 as described above are similar to or the same as the paper feeding unit, the exposure unit, the fixing unit, the paper discharging unit and the controller of a conventional image forming apparatus. Therefore, detailed descriptions thereof are omitted.

Also, the paper feeding unit 20, the image forming unit 30, the exposure unit 40, the fixing unit 50, and the paper discharging unit 60 are fixed inside the main body frame 10. As illustrated in FIG. 2, a mounting groove 11 in which the waste developer receptacle 80 is inserted and mounted may be provided in a side surface of the main body frame 10. The mounting groove 11 is concavely formed in a shape corresponding to the shape of the waste developer receptacle 80 in the side surface of the main body frame 10. A lever member 160 of the gap control unit 100 is rotatably disposed in a bottom surface of the mounting groove 11. A cover 17 is detachably disposed on the side surface of the main body frame 10 in which the mounting groove 11 is provided. Accordingly, in order to mount or remove the waste developer receptacle 80, the cover 17 should be separated from the main body frame 10. In an exemplary embodiment as illustrated in FIG. 2, the waste developer receptacle 80 is mounted in the recessed mounting groove 11. However, the waste developer receptacle 80 does not have to be disposed in the mounting groove 11. In an exemplary embodiment of the present general inventive concept, the waste developer receptacle 80 may be disposed in a state in which the waste developer receptacle 80 is fixed to the main body frame 10 and protrudes from the side surface of the main body frame 10.

The waste developer receptacle 80 is detachably mounted in the main body frame 10, and stores waste developer that remains in the image forming unit 30 after printing. Accordingly, after the developer image is transferred onto the print medium P, the waste developer remaining on the image carrier 32 is collected into the waste developer receptacle 80. Referring to FIG. 4, a rear surface of the waste developer receptacle 80 is provided with an inlet 81 through which the collected waste developer comes from the image forming unit 30 through a waste developer path (not illustrated) and a lever member receiving groove 83 in which the lever member 160 of the gap control unit 100 is accommodated.

Figure 5:
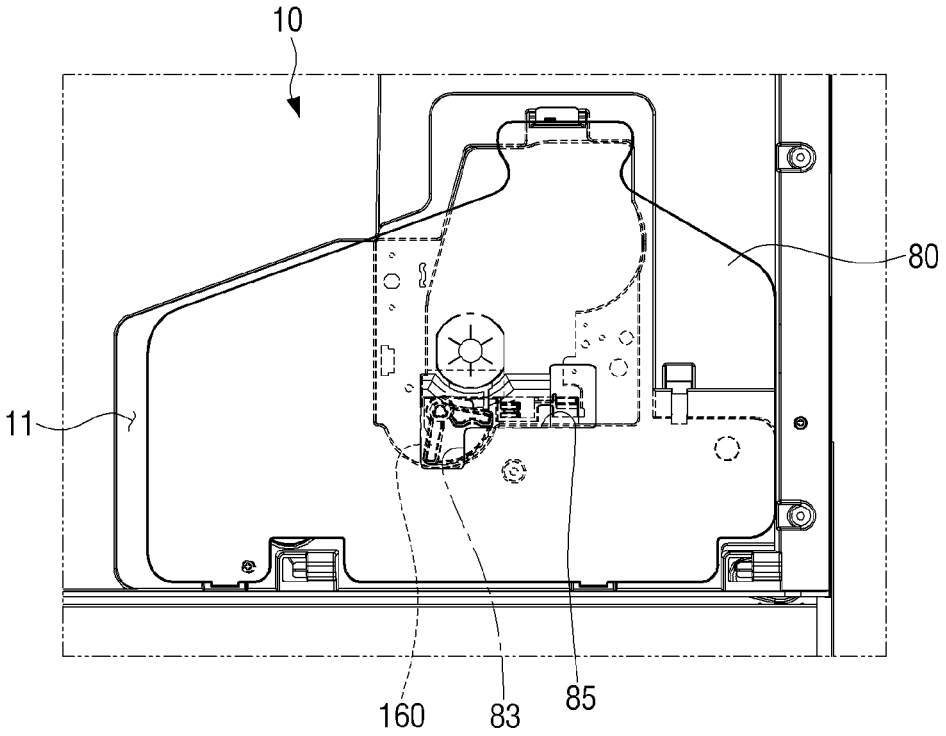
FIG. 5 is a view illustrating a state of a lever member when a waste developer receptacle is mounted in the image forming apparatus of FIG. 2.
Figure 6:
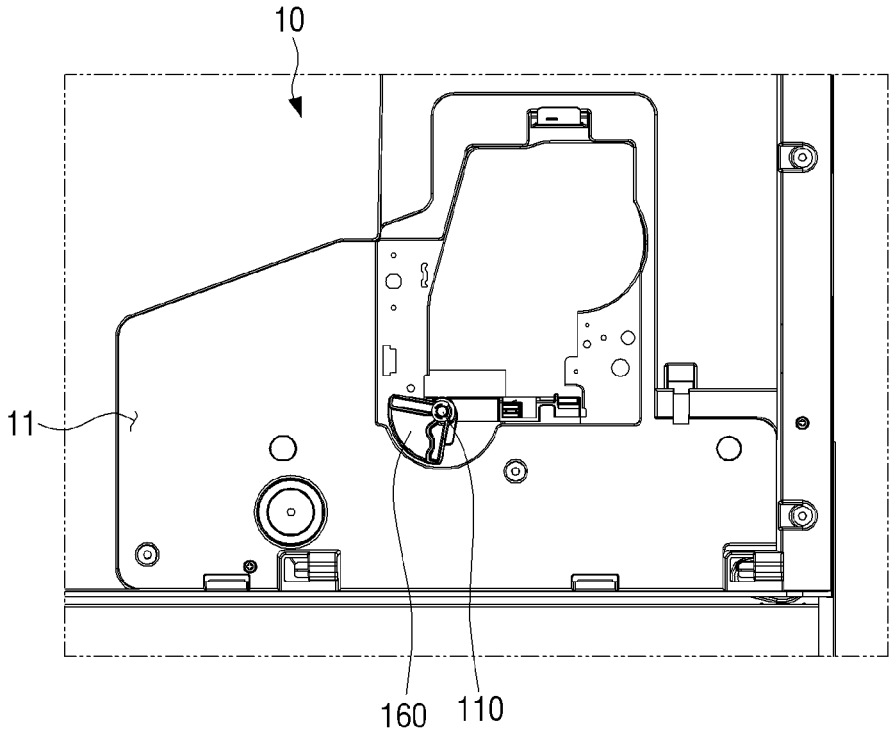
FIG. 6 is a view illustrating a posture of a lever member when a waste developer receptacle is removed from a mounting groove of an image forming apparatus.
Figure 7:
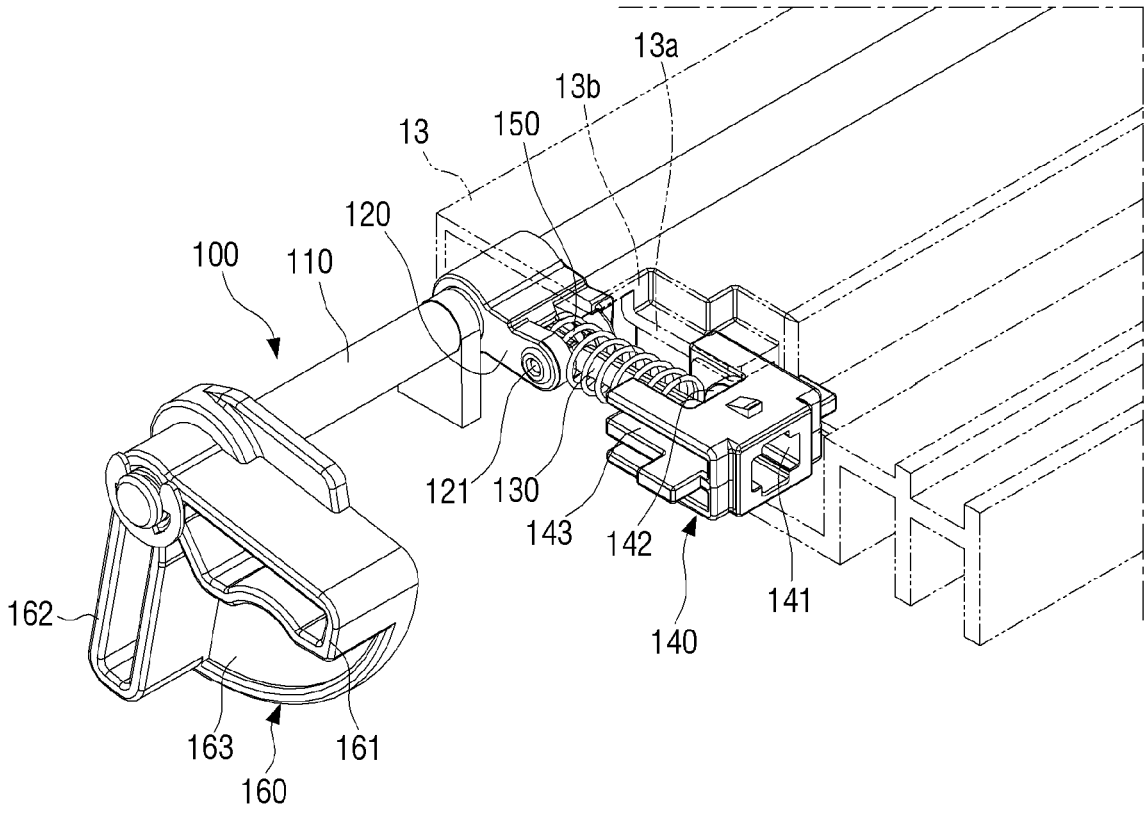
FIG. 7 is a partial perspective view illustrating a gap control unit of an image forming apparatus according to an embodiment of the present general inventive concept.

With further reference to FIG. 4, the lever member receiving groove 83 includes a lever member operating rib 84 that operates the lever member 160 and a stopper 85 that limits rotation of the lever member 160 by the lever member operating rib 84. The lever member receiving groove 83 is formed in a shape corresponding to the lever member 160. In an exemplary embodiment of the present general inventive concept, the lever member 160 is formed in a substantially L-shape as illustrated in FIG. 7, so the lever member receiving groove 83 is also formed in the substantially L-shape to accommodate the lever member 160. Accordingly, when the lever member 160 is placed in a contact position, the lever member 160 is inserted into the lever member receiving groove 83 of the waste developer receptacle 80 so that the waste developer receptacle 80 may be inserted in the mounting groove 11 of the main body frame 10 as illustrated in FIG. 5. In this state, if the waste developer receptacle 80 is separated from the mounting groove 11 of the main body frame 10, the lever member 160 is automatically moved to a separation position as illustrated in FIG. 6. The image forming unit 30, including both the photographing unit 31 and the developing unit 33 are omitted from FIGS. 5 and 6 for simplicity of illustration. However, it will be understood that the image forming unit 30 may be located in the same location relative to the gap control unit 100 as illustrated in FIG. 3.

The gap control unit 100 according to the present general inventive concept controls the spacing of a gap G between the image carrier 32 and the developing member 34. Depending on the configuration of a particular embodiment of the present general inventive concept, the gap control unit 100 may control the gap G according to a distance D between two ends of the gap control unit (described in detail below with reference to FIGS. 8 and 10), an angle between two components (described in detail below with reference to FIGS. 8 and 10), or a combination thereof.

Figure 8:
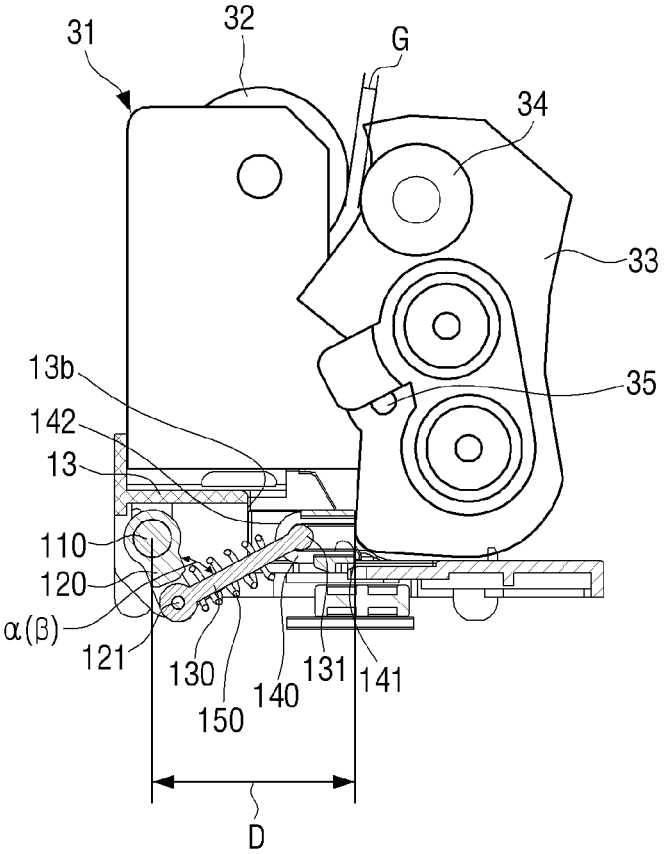
FIG. 8 is a view illustrating a state in which a developing unit is not pressurized by the gap control unit of FIG. 7.
Figure 9:
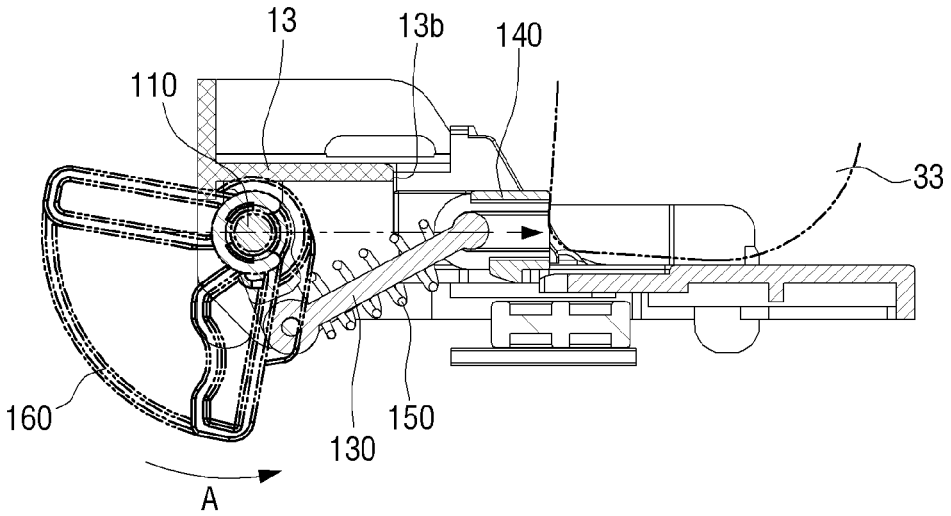
FIG. 9 is a view illustrating a state of a gap control unit when a lever member is placed in a separation position.
Figure 10:
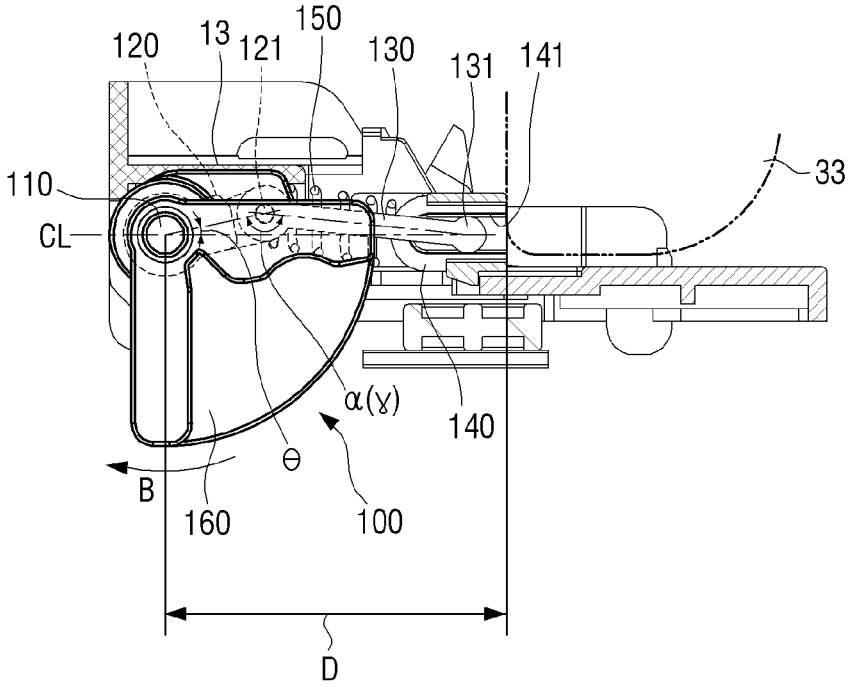
FIG. 10 is a view illustrating a state of a gap control unit when a lever member is placed in a contact position.
Figure 11:
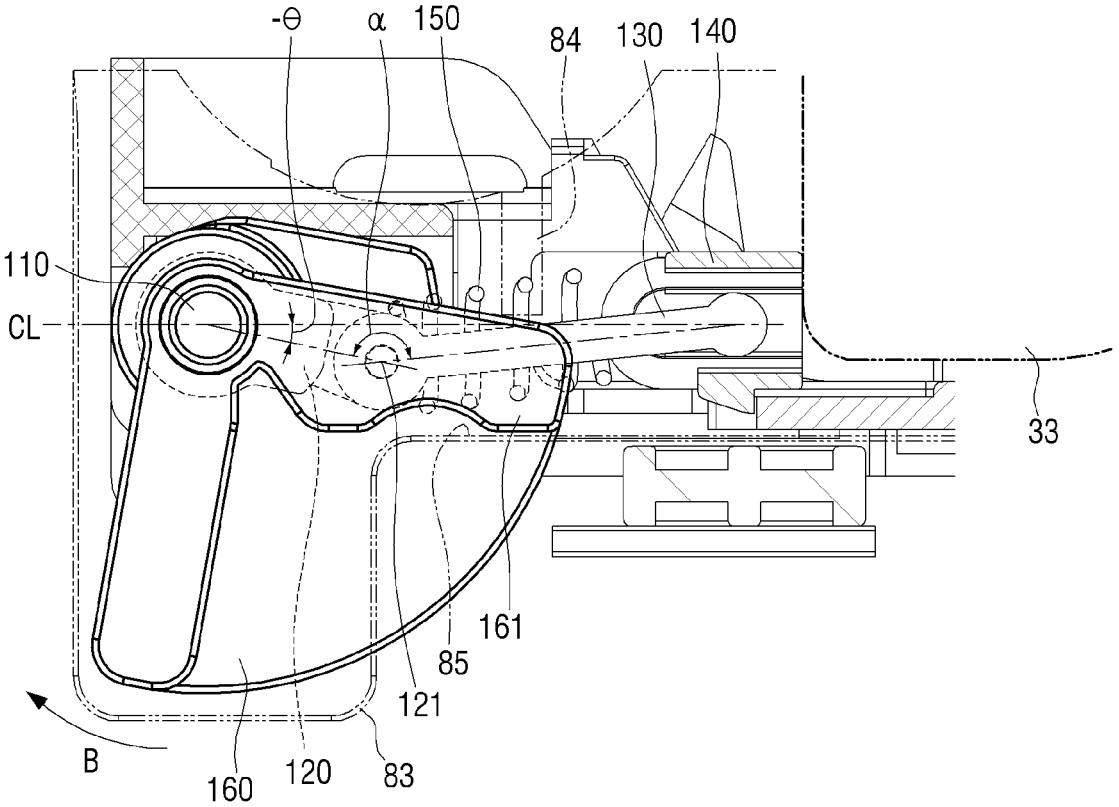
FIG. 11 is a view illustrating a state of a gap control unit when a lever member is inserted into a lever member receiving groove of a waste developer receptacle.
Figure 12:
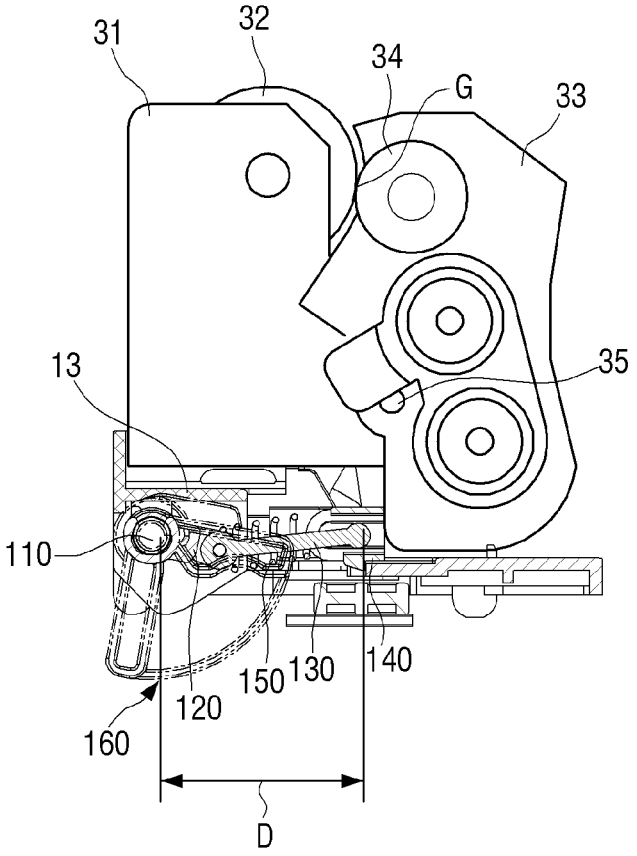
FIG. 12 is a view illustrating a state in which a developing member of a developing unit is in contact with an image carrier of a photographing unit by a gap control unit when a lever member is inserted into a lever member receiving groove of a waste developer receptacle.

FIG. 7 is a partial perspective view illustrating a gap control unit 100 of an image forming apparatus 1 according to an exemplary embodiment of the present general inventive concept. FIG. 8 is a view illustrating a state in which the developing unit 33 is not pressurized by the gap control unit 100 of FIG. 7. FIG. 9 is a view illustrating a state of the gap control unit 100 when the lever member 160 is placed in a separation position, and FIG. 10 is a view illustrating a state of the gap control unit 100 when the lever member 160 is placed in a contact position. FIG. 11 is a view illustrating a state of the gap control unit 100 when the lever member 160 is inserted into the lever member receiving groove 83 of the waste developer receptacle 80. FIG. 12 is a view illustrating a state in which a developing member 34 of the developing unit 33 is in contact with the image carrier 32 of the photographing unit 31 by the gap control unit 100 when the lever member 160 is inserted into the lever member receiving groove 83 of the waste developer receptacle 80. More specifically, when the lever member 160 is placed in the contact position, the image carrier 32 and the developing member 34 are separated by the gap G having a first spacing. Depending on the particular embodiment of the present general inventive concept, the first spacing may be zero, in the case that the image carrier 32 and developing member 34 are physically contacting each other as illustrated for example in FIG. 12. Alternatively, the first spacing may be a non-zero distance less than that of a second spacing of the gap G between the image carrier 32 and the developing member 34 when the lever 160 is in the separation position (illustrated for example in FIG. 8).

Referring to FIGS. 7 to 12, the gap control unit 100 that rotates the developing unit 33 of the image forming unit 30 of the image forming apparatus 1 according to an exemplary embodiment of the present general inventive concept by a certain angle includes a rotation shaft 110, a crank arm 120, a link member 130, a pressing member 140, an elastic member 150, and the lever member 160.

The rotation shaft 110 is rotatably disposed in the main body frame 10. One end of the rotation shaft 110 is protruded from the side surface of the main body frame 10. The lever member 160 that can rotate the rotation shaft 110 is disposed in the protruded one end of the rotation shaft 110. In a case of the present exemplary embodiment, the one end of the rotation shaft 110 is protruded from the bottom surface of the mounting groove 11. Accordingly, the lever member 160 is rotatably disposed in the bottom surface of the mounting groove 11 of the main body frame 10. If the lever member 160 is rotated, the rotation shaft 110 is rotated integrally with the lever member 160.

The crank arm 120 is disposed in the rotation shaft 110. Since the crank arm 120 is fixed to the rotation shaft 110, if the rotation shaft 110 is rotated, the crank arm 120 is also rotated integrally with the rotation shaft 110. Accordingly, if the lever member 160 is rotated by a certain angle, the crank arm 120 is also rotated at the same angle in the same direction as the lever member 160. An angle the crank arm 120 makes with a center line CL (described in detail below with reference to FIG. 10) may control the spacing of the gap G.

The rotation of the crank arm 120 is limited by a supporting member 13 of the main body frame 10. For example, in the case of the gap control unit 100 as illustrated in FIG. 10, if the crank arm 120 is rotated by a certain angle in the counterclockwise direction (a direction of an arrow A, illustrated in FIG. 9), one end of the crank arm 120 interferes with the supporting member 13 so that the crank arm 120 cannot be further rotated. In other words, the supporting member 13 performs a function of a first stopper that limits an angle by which the crank arm 120 can be rotated in the counterclockwise direction.

The link member 130 is disposed between the crank arm 120 and the pressing member 140. One end of the link member 130 is connected to the pressing member 140, and the other end of the link member 130 is connected to the one end of the crank arm 120. The other end of the link member 130 is rotatably connected to the one end of the crank arm 120. In the case of the present exemplary embodiment, the other end of the link member 130 and the one end of the crank arm 120 are connected by a rotation pin 121 so that the link member 130 and the crank arm 120 can be freely rotated with respect to each other. The link member 130 and the crank arm 120 therefore form an angle $\alpha$ therebetween (illustrated for example in FIG. 8), which may control the spacing of the gap G between the image carrier 32 and the developing member 34. When the lever member 160 is in the separation position (illustrated for example in FIG. 8), the angle $\alpha$ has a first size $\beta$, while when the lever member 160 is in the contact position (illustrated for example in FIG. 10), the angle $\alpha$ has a second size $\gamma$, described in greater detail below.

A guide projection 131 that can be inserted in an elongate groove 141 of the pressing member 140 is provided in the one end of the link member 130. The guide projection 131 may be formed in a cylindrical shape. The link member 130 is connected to perform a rotational motion and a linear motion with respect to the pressing member 140. The link member 130 plays a role to convert the rotation of the crank arm 120 into the linear motion of the pressing member 140.

The pressing member 140 is configured to apply a force to a lower portion of the developing unit 33 to push the developing unit 33 in a direction. The pressing member 140 may be disposed to move linearly in the supporting member 13. Accordingly, the supporting member 13 may be provided with a pair of guide rails 13*a* to guide the pressing member 140. The distance D between the shaft 110 and the leading end of the pressing member 140 may control the spacing of the gap G between the image carrier 32 and the developing member 34 When the lever member 160 is in the separation position (illustrated for example in FIGS. 8 and 9), the distance D is a first distance shorter than a second distance formed when the lever member 160 is in the contact position (illustrated for example in FIG. 10).

The pressing member 140 is formed in a hollow substantially rectangular parallelepiped shape, and each of opposite inner side surfaces of the pressing member 140 is provided with the elongate groove 141. The pair of elongate grooves 141 is formed parallel to a moving direction of the pressing member 140 so that opposite ends of the guide projection 131 of the link member 130 can be inserted and moved in the pair of elongate grooves 141. The length of the elongate grooves 141 is determined so that the rotational motion of the crank arm 120 can be converted into the linear motion. The pressing member 140 is moved toward the developing unit 33 by an elastic force of the elastic member 150 that is applied to the pressing member 140. The developing unit 33 is rotated on the hinge shaft 35 (illustrated in FIG. 8) by the movement of the pressing member 140. This widens the gap G between the image carrier 32 and developing member 34, such that the gap G has the second spacing defined by the separation position illustrated in FIGS. 8 and 9.

A pair of guide grooves 143 may be provided on opposite outer side surfaces of the pressing member 140. The pair of guide grooves 143 is formed to be inserted in the pair of guide rails 13*a* that is provided in the supporting member 13. The pair of guide rails 13*a* provided in the supporting member 13 is formed in the form of square bars facing each other. Accordingly, each of the pair of guide grooves 143 may be formed in a groove having a square cross-section corresponding to the square bar. If the pair of guide rails 13*a* of the supporting member 13 is inserted in the pair of guide grooves 143 of the pressing member 140, the pressing member 140 can linearly move along the pair of guide rails 13*a* of the supporting member 13. FIG. 7 illustrates only one of the pair of guide rails 13*a* formed in the supporting member 13, for simplicity of illustration.

A second stopper 13*b* that limits one direction movement of the pressing member 140 may be provided in an end of at least one of the pair of guide rails 13*a* of the supporting member 13. The second stopper 13*b* limits the moving distance of the pressing member 140 in a direction away from the developing unit 33. As illustrated in FIGS. 7 and 8, the second stopper 13*b* is provided in a direction perpendicular to the guide rail 13*a* in one end of the guide rail 13*a* of the supporting member 13. Accordingly, when the lever member 160 is moved to the separation position, the second stopper 13*b* limits the movement of the pressing member 140.

A leading end of the pressing member 140 is brought into contact with the lower portion of the developing unit 33 by the elastic member 150, as illustrated for example in FIGS. 9-10. At this time, the leading end of the pressing member 140 and the lower portion of the developing unit 33 may be formed to be in surface contact or point contact with each other.

The elastic member 150 is disposed around the link member 130, and elastically supports the pressing member 140. In detail, the link member 130 is inserted in the elastic member 150. Accordingly, if the link member 130 is disposed between the pressing member 140 and the crank arm 120, the elastic member 150 applies a force to the pressing member 140. In other words, one end of the elastic member 150 is supported by the one end of the crank arm 120, and the other end of the elastic member 150 is supported by a rear end of the pressing member 140, in detail, by a rear end of an elongate groove portion 142 in which the elongate grooves 141 are formed. The one end of the crank arm 120 and the rear end of the elongate groove portion 142 are formed in a curved surface so that, when the link member 130 is rotated by the crank arm 120, the link member 130 does not interfere with the elastic member 150.

Since the one end of elastic member 150 is supported by the crank arm 120 and the elastic member 150 is guided by the link member 130, the elastic member 150 pushes the pressing member 140 toward the developing unit 33. Accordingly, a coil spring may be used as the elastic member 150. At this time, the coil spring 150 has an elastic force that allows the pressing member 140 to press the lower portion of the developing unit 33 so that the developing unit 33 is rotated on the hinge shaft 35 so that the developing member 34 is brought into contact with the image carrier 32 of the photographing unit 31, as illustrated for example in FIG. 12. In other words, by only the elastic force of the coil spring 150, the developing unit 33 may be rotated so that the developing member 34 is brought into contact with the image carrier 32, thereby forming a proper developing nip between the developing member 34 and the image carrier 32.

The force which the elastic member 150 applies to the pressing member 140 varies depending on the rotation of the crank arm 120. As illustrated in FIG. 9, when the lever member 160 is placed in the separation position, the rear end of the pressing member 140 is in contact with the second stopper 13*b* so that the elastic member 150 is a state to receive no force or a minimum force. At this time, the elastic member 150 may be in an uncompressed or minimally compressed state. Accordingly, when the lever member 160 is placed in the separation position, no force is applied to the developing unit 33 by the gap control unit 100.

Then, if the lever member 160 is rotated in the counterclockwise direction (a direction of arrow A) as illustrated in FIG. 9, the crank arm 120 is also rotated in the counterclockwise direction. When the crank arm 120 is rotated in the counterclockwise direction, the elastic member 150 receives a force by the crank arm 120, thereby being compressed. When the link member 130 and the crank arm 120 makes a straight line (namely, when the lever member 160 reaches an inflection point), the elastic member 150 is compressed to the maximum. After that, if the lever member 160, and by extension the crank arm 120, is rotated over the inflection point, the force which is applied to the elastic member 150 is again decreased. When the lever member 160 is rotated by a predetermined angle over the inflection point in the counterclockwise direction, as illustrated in FIG. 10, the crank arm 120 is brought into contact with the supporting member 13 of the first stopper so that crank arm 120 may not be further rotated. When the crank arm 120 is in contact with the first stopper 13, because the pressing member 140 that receives the force by the elastic force of the elastic member 150 presses the lower portion of the developing unit 33, the developing unit 33 is rotated on the hinge shaft 35 so that the developing member 34 is brought into contact with the image carrier 32. This configuration is illustrated in FIG. 12.

The lever member 160 is disposed at one end of the gap control unit 100, in detail, at the one end of the rotation shaft 110 so that the lever member 160 can operate the gap control unit 100. The lever member 160 may move between the contact position illustrated in FIG. 10, in which the gap control unit 100 is operated so that the image carrier 32 and the developing member 34 are in contact with each other, and the separation position illustrated in FIG. 9, in which the gap control unit 100 is operated so that the image carrier 32 and the developing member 34 are spaced apart from each other.

In the exemplary embodiment of the present general inventive concept illustrated in FIGS. 7-12, the lever member 160 is formed in a substantially L-shape. In detail, the lever member 160 is configured of two arms 161 and 162 that are connected substantially at 90 degrees as illustrated in FIG. 7, and bottom surfaces of the two arms 161 and 162 are connected by a bottom plate 163 of a fan shape. A user may rotate the lever member 160 by hand so that the lever member 160 is placed in the contact position or the separation position. It will be understood that in this exemplary embodiment of the present general inventive concept, if the user moves the lever member 160 to the contact position the elastic member 150 may maintain the lever member 160 in the contact position. That is, moving the lever member 160 away from the contact position would move the lever member 160 clockwise (in the direction of an arrow B in FIG. 10) towards the inflection point, which would compress the elastic member 150 and therefore generate a force urging the lever member 160 counterclockwise, towards the contact position. Therefore, once the user has moved the lever member 160 to the contact position, the lever member 160 will remain in the contact position without a need for further user interaction. Also, the lever member 160 may be rotated by mounting or removing of the waste developer receptacle 80. Furthermore, the lever member 160 as illustrated in FIG. 7 is only one example; the shape of the lever member 160 is not limited to just the L-shape illustrated therein. It will be understood that the lever member 160 may be formed in any shape capable of moving between the contact position and the separation position, depending on the particular configuration of an embodiment of the present general inventive concept. As another example, the lever member 160 may be formed in a bar shape.

The waste developer receptacle 80 is detachably disposed in the main body frame 10. However, only when the lever member 160 is placed in the contact position (illustrated in FIG. 10), the waste developer receptacle 80 may be mounted in the main body frame 10. When the lever member 160 is placed in the separation position (illustrated in FIG. 9), the waste developer receptacle 80 may not be mounted in the main body frame 10. For this, the lever member receiving groove 83 that can receive the lever member 160 which is placed in the contact position is provided in the rear surface of the waste developer receptacle 80 (see FIG. 4).

The lever member receiving groove 83 of the waste developer receptacle 80 is configured of a vertical groove 83*a* and a horizontal groove 83*b* that are formed in the substantially L-shape corresponding to the lever member 160 so that the lever member 160 can be inserted into the lever member receiving groove 83. Each of the vertical groove 83*a* and horizontal groove 83*b* of the lever member receiving groove 83 is formed to have a width wider than the width of each of the arms 161 and 162 of the lever member 160 so that the lever member 160 can be rotated by a predetermined angle within the lever member receiving groove 83. The lever member operating rib 84 that presses the lever member 160 in a clockwise direction (direction B in FIG. 11), in detail, that presses the arm 161 of the lever member 160 in the clockwise direction, is provided on a top surface of the horizontal groove 83*b*. The lever member operating rib 84 is formed to include an inclined surface 84*a* (see FIG. 13A) that is in contact with the lever member 160. Accordingly, when the waste developer receptacle 80 is mounted, the lever member 160 receives a force by the inclined surface 84*a* of the lever member operating rib 84 provided in the lever member receiving groove 83 of the waste developer receptacle 80 so as to be rotated clockwise.

Figure 13A:
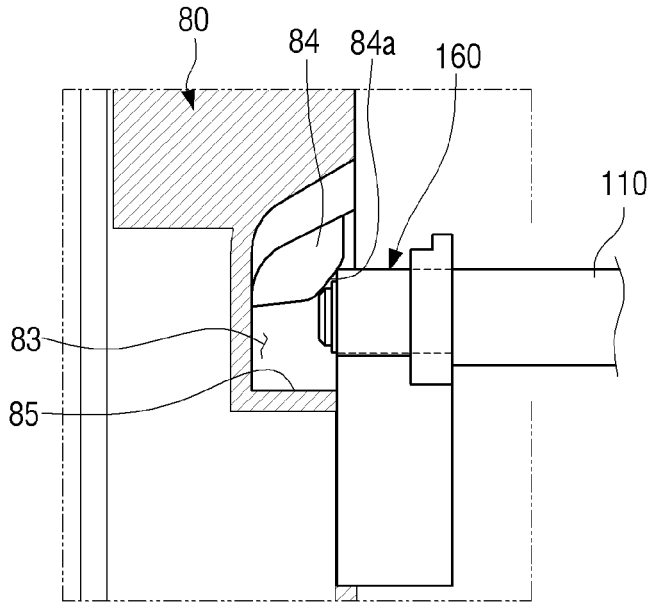
FIG. 13A is a view illustrating a state just before a lever member operating rib of a waste developer receptacle is in contact with a lever member when the lever member is placed in a contact position.
Figure 13B:
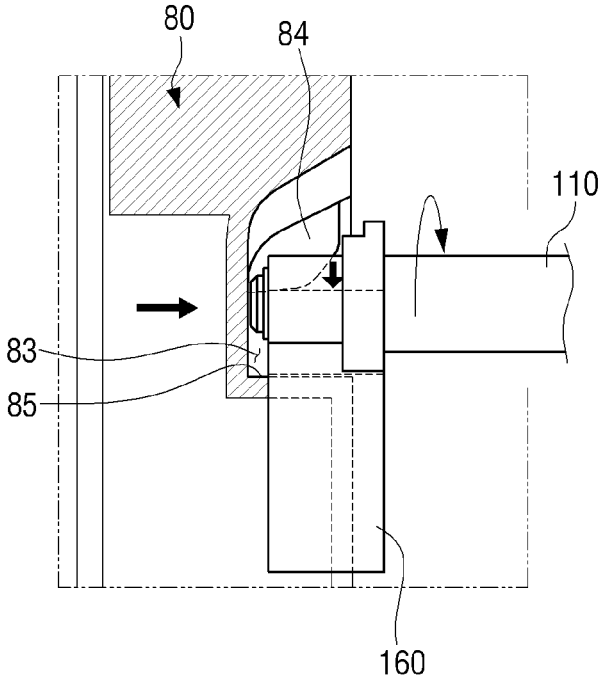
FIG. 13B is a view illustrating a case in which a lever member is rotated to be a state of FIG. 11 by a lever member operating rib when a waste developer receptacle is inserted.

Rotating operation of the lever member 160 by the lever member operating rib 84 will be described in detail with reference to FIGS. 13A and 13B. FIGS. 13A and 13B are partial views illustrating the lever member receiving groove 83 and the lever member 160 by cutting a portion of the waste developer receptacle 80 in order to illustrate that the lever member 160 is rotated by the lever member operating rib 84. FIG. 13A is a view illustrating a state just before the lever member operating rib 84 of the waste developer receptacle 80 is in contact with the lever member 160 when the lever member 160 is placed in the contact position, and FIG. 13B is a view illustrating a state in which, when the waste developer receptacle 80 is completely inserted, the lever member 160 is rotated by the lever member operating rib 84 so that the lever member 160 is supported by the bottom surface 85 of the lever member receiving groove 83.

As illustrated in FIG. 13A, before the inclined surface 84*a* of the lever member operating rib 84 of the waste developer receptacle 80 is in contact with the lever member 160, the lever member 160 remains in the contact position. If the waste developer receptacle 80 is inserted, the lever member 160 is inserted in the lever member receiving groove 83. At this time, the lever member 160 is urged clockwise by the inclined surface 84*a* of the lever member operating rib 84 provided on the top surface of the lever member receiving groove 83 so that the lever member 160 is rotated clockwise, i.e., towards the separation position. However, the rotation of the lever member 160 is limited by the bottom surface 85 of the horizontal groove 83*b* of the lever member receiving groove 83.

In other words, the bottom surface 85 of the horizontal groove 83*b* of the lever member receiving groove 83 serves as a stopper to limit the rotation of the lever member 160 that is rotated by the lever member operating rib 84. At this time, the bottom surface 85 of the horizontal groove 83*b* is provided in a position in which the gap control unit 100 presses the developing unit 33 with a force that is the same as to or similar to the force with which the gap control unit 100 presses the developing unit 33 when the lever member 160 is in the contact position. In other words, the bottom surface 85 of the horizontal groove 83*b* is formed so that, when the arm 161 of the lever member 160 is in contact with the bottom surface 85 of the horizontal groove 83*b* of the lever member receiving groove 83, the angle of the crank arm 120 is the same as or similar to the angle of the crank arm 120 when the lever member 160 is placed in the contact position. In detail, when the lever member 160 is in the contact position, as illustrated in FIG. 10, the crank arm 120 forms a certain angle θ about the center line CL that is formed when the crank arm 120 and the link member 130 makes a straight line, i.e., when the lever member 160 is at the inflection point. Accordingly, as illustrated in FIG. 11, the bottom surface 85 of the horizontal groove 83*b* is formed so that, when the arm 161 of the lever member 160 is in contact with the bottom surface 85 of the horizontal groove 83*b*, the crank arm 120 forms the same or similar angle θ about the center line CL (the center line formed when the crank arm 120 and the link member 130 makes a straight line). However, when the lever member 160 is supported by the horizontal groove 83*b* of the lever member receiving groove 83, the angle of the crank arm 120 is in the opposite direction about the center line CL from the angle of the crank arm 120 when the lever member 160 is in the contact position. For example, if, when the lever member 160 is in the contact position, the crank arm 120 is placed in a position where the crank arm 120 forms an angle of +θ against the center line CL as illustrated for example in FIG. 10, then when the lever member 160 is supported by the waste developer receptacle 80, the crank arm 120 is placed in a position where the crank arm 120 forms an angle of −θ against the center line CL, as illustrated for example in FIG. 11. Accordingly, when the lever member 160 is in contact with the bottom surface 85 of the horizontal groove 83*b* of the lever member receiving groove 83 of the waste developer receptacle 80, namely, the stopper 85 as illustrated in FIG. 11, the angle α between the crank arm 120 and the link member 130 has a size that is the same as or similar to that of the size γ of the angle α between the crank arm 120 and the link member 130 when the crank arm 120 is in contact with the first stopper 13 as illustrated in FIG. 10. Hereinafter, the position in which the lever member 160 is supported by the horizontal groove 83*b* of the waste developer receptacle 80 to press the developing unit 33 so that the developing member 34 and the image carrier 32 are brought into contact with each other will be referred to as a support position.

Accordingly, when the lever member 160 is in the contact position as illustrated in FIG. 10, if the waste developer receptacle 80 is inserted into the mounting groove 11 of the main body frame 10, the lever member 160 is rotated by a predetermined angle by the lever member operating rib 84, thereby being placed in the support position, as illustrated in FIG. 11. When the lever member 160 is in the support position, then as illustrated in FIG. 12 the developing member 34 is in contact with the image carrier 32 so that a proper developing nip is formed between the developing member 34 and the image carrier 32.

When the lever member 160 is in the support position where the lever member 160 is supported by the waste developer receptacle 80, if the waste developer receptacle 80 is removed from the main body frame 10, the lever member 160 is moved to the separation position by the elastic member 150 of the gap control unit 100. That is, the elastic member 150 exerts a force against the lever member 160 to rotate the lever member 160 clockwise. If the lever member 160 is moved to the separation position, the developing unit 33 is rotated on the hinge shaft 35 by the gap maintaining member (not illustrated) so that the developing member 34 is spaced apart from the image carrier 32 by the gap G having the second spacing (illustrated in FIG. 8).

Figure 14:
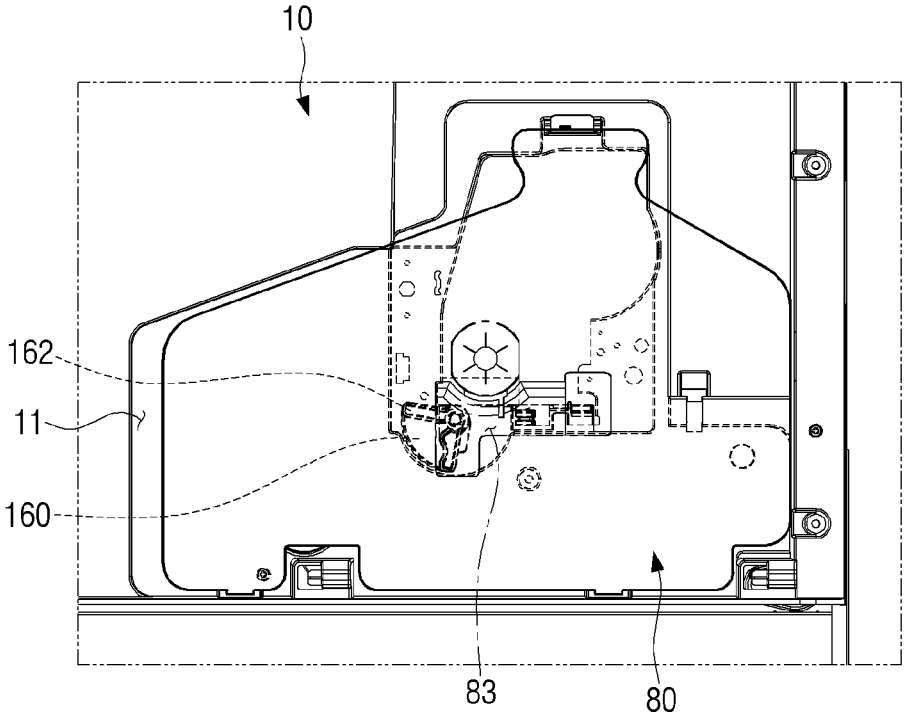
FIG. 14 is a view illustrating a state in which a lever member interferes with a waste developer receptacle when the lever member is placed in a separation position.

When the lever member 160 is in the separation position, the waste developer receptacle 80 cannot be mounted in the mounting groove 11 of the main body frame 10. This is because the lever member 160 interferes with the lever member receiving groove 83 of the waste developer receptacle 80. When the lever member 160 is in the separation position, as illustrated in FIG. 14, the arm 162 of the lever member 160 is placed in the opposite direction against the horizontal groove 83*b* of the lever member receiving groove 83 of the waste developer receptacle 80 so that the lever member 160 interferes with the waste developer receptacle 80. FIG. 14 illustrates only the rear surface of the waste developer receptacle 80 and the lever member 160 in order to explain interference between the lever member 160 and the waste developer receptacle 80. As described above, when the lever member 160 is in the separation position, the waste developer receptacle 80 may not be mounted in the main body frame 10, and as a result the image forming apparatus 1 cannot operate normally.

Generally, if the waste developer receptacle 80 is not mounted, the controller 70 of the image forming apparatus 1 notifies a user that the waste developer receptacle 80 is not mounted, and controls the image forming apparatus 1 not to perform printing. Accordingly, with the image forming apparatus 1 according to an exemplary embodiment of the present general inventive concept, if the lever member 160 is not placed in the contact position, the waste developer receptacle 80 may not be mounted, and if the waste developer receptacle 80 is not mounted, the image forming apparatus 1 may not perform printing. Therefore, operation of the image forming apparatus 1 while the developing member 34 is not contact with the image carrier 32 may be prevented.

Further, as illustrated in FIG. 5, in a state in which the waste developer receptacle 80 is mounted in the main body frame 10, the lever member 160 is placed in the support position in which the lever member 160 is supported by the lever member receiving groove 83 of the waste developer receptacle 80. When the lever member 160 is in the support position, the crank arm 120 of the gap control unit 100 is placed below the inflection point. Therefore, if the waste developer receptacle 80 is separated, the crank arm 120 is further rotated in the clockwise direction by the elastic member 150 of the gap control unit 100 so that the force which the pressing member 140 of the gap control unit 100 applies to the developing unit 33 is removed. Accordingly, the developing unit 33 is rotated by a predetermined angle against the photographing unit 31 by the gap maintaining member (not illustrated) to be returned to an original position so that the developing member 34 is spaced apart from the image carrier 32. Accordingly, with the image forming apparatus 1 according to an exemplary embodiment of the present general inventive concept, by separating the waste developer receptacle 80 from the main body frame 10, the developing member 34 is automatically spaced apart from the image carrier 32, so a case in which the user does not place the lever member 160 in the separation position and separates the developing unit 33 and the photographing unit 31 may not occur.

Hereinafter, a maintenance method of an image forming apparatus 1 with the structure as described above according to an exemplary embodiment of the present general inventive concept will be described with reference to accompanying drawings.

Figure 15:
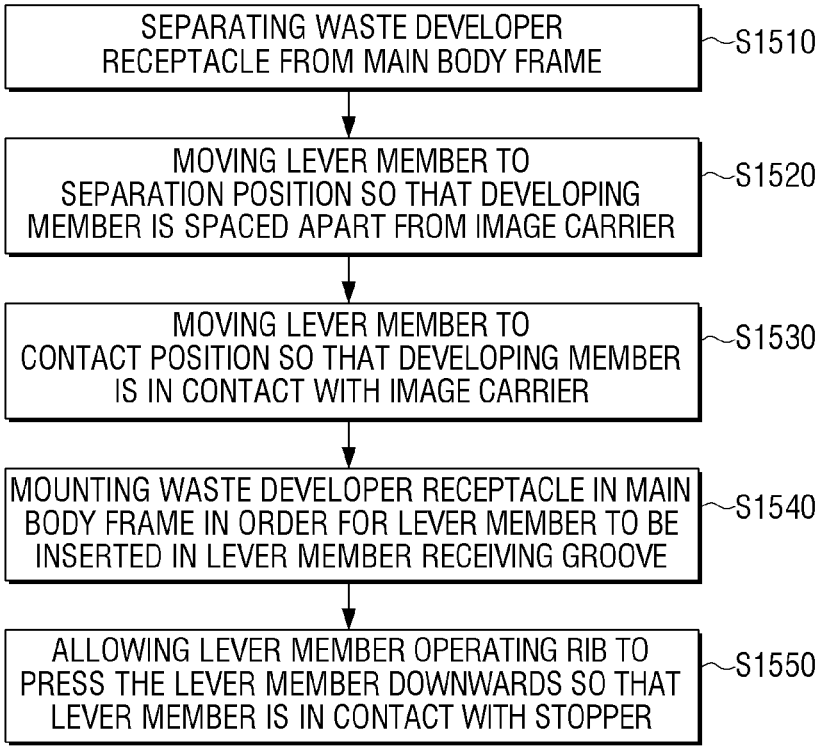
FIG. 15 is a flowchart illustrating a maintenance method of an image forming apparatus according to an embodiment of the present general inventive concept.
Figure 16:
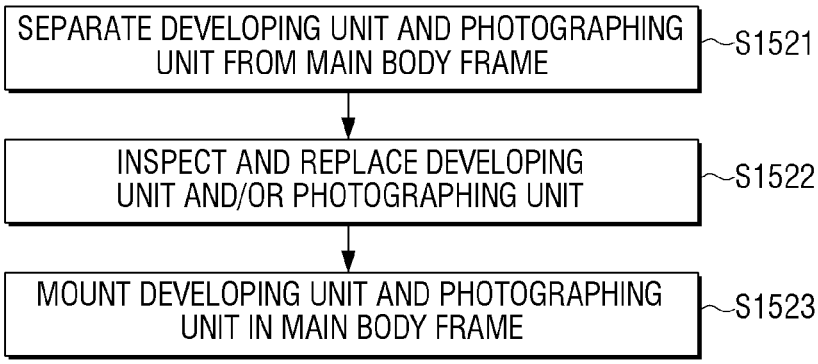
FIG. 16 is a flowchart illustrating one type of maintenance which may be performed according to the maintenance method of FIG. 15.

FIG. 15 is a flowchart illustrating a maintenance method of an image forming apparatus 1 according to an exemplary embodiment of the present general inventive concept. FIG. 16 is a flowchart illustrating one type of maintenance which may be performed according to the maintenance method of FIG. 15.

First, in order to remove the developing unit 33 or the photographing unit 31, a user or a service staff separates the waste developer receptacle 80 from the main body frame 10 (operation S1510). For this, the cover 17 that is provided to cover the waste developer receptacle 80 is removed, and then the waste developer receptacle 80 is removed from the mounting groove 11.

After the waste developer receptacle 80 is removed, the lever member 160 is automatically moved to the separation position so that the developing member 34 of the developing unit 33 is spaced apart from the image carrier 32 of the photographing unit 31 (operation S1520). In detail, if the waste developer receptacle 80 blocking the rotation of the lever member 160 is removed, the crank arm 120 is rotated in the counterclockwise direction (a direction of arrow B) of FIG. 11 by the elastic force of the elastic member 150 of the gap control unit 100 to be a state as illustrated in FIG. 9 so that a force pressing the developing unit 33 is removed. Then, by the gap maintaining member (not illustrated) between the developing unit 33 and the photographing unit 31, the developing unit 33 is rotated by a predetermined angle to be returned to the original position so that the developing member 34 and the image carrier 32 are spaced apart from each other by the gap G having the second spacing as illustrated in FIG. 8.

In a state in which the developing member 34 is spaced apart from the image carrier 32, the user may perform maintenance on the developing unit 33 and the photographing unit 31 without danger of damaging the image carrier 32 and the developing member 34. The type of maintenance depends on the immediate embodiment of the present general inventive concept and the desire of the user. In the exemplary embodiment of the present general inventive concept illustrated in FIG. 16, after operation S1520 the user separates the developing unit 33 and the photographing unit 31 from the main body frame 10 (operation S1521).

As further illustrated in FIG. 16, the user inspects the developing unit 33 and the photographing unit 31. If there is a problem, the user replaces the developing unit 33 or the photographing unit 31 with a new one (operation S1522).

After that, the user again mounts the developing unit 33 and the photographing unit 31 in the main body frame 10 (operation S1523). At this time, if at least one of the photographing unit 31 and developing unit 33 is replaced with new one, the new one is mounted in the main body frame 10. If the both the photographing unit 31 and the developing unit 33 are not replaced, the separated photographing unit 31 and developing unit 33 are again mounted in the main body frame 10.

Returning to FIG. 15, after maintenance of the photographing unit 31 and the developing unit 33 is completed, in operation S1530 the user rotates the lever member 160 to the contact position. When the lever member 160 is moved to the contact position, the developing unit 33 is rotated by the gap control unit 100 so that the developing member 34 of the developing unit 33 is brought into contact with the image carrier 32 of the photographing unit 31.

After that, in order for the lever member 160 in the contact position to be inserted into the lever member receiving groove 83 of the waste developer receptacle 80, the user mounts the waste developer receptacle 80 in the mounting groove 11 of the main body frame 10 (operation S1540).

If the waste developer receptacle 80 is mounted in the main body frame 10, the lever member operating rib 84 of the lever member receiving groove 83 presses the lever member 160 downwards so that the lever member 160 is brought into contact with the stopper, or the lower surface 85 of the lever member receiving groove 83 (operation S1550).

Since the state in which the lever member 160 is supported by the lever member receiving groove 83 of the waste developer receptacle 80 is the state in which the gap control unit 100 presses the developing unit 33, the developing member 34 of the developing unit 33 remains to be in contact with the image carrier 32 of the photographing unit 31. When the lever member 160 is in contact with the stopper 85 of the lever member receiving groove 83 of the waste developer receptacle 80, a force that is applied to the developing unit 33 by the gap control unit 100 is the same as or similar to a force that is applied to the developing unit 33 by the gap control unit 100 when the lever member 160 is in the contact position.

As described above, with a maintenance method of an image forming apparatus 1 according to an exemplary embodiment of the present general inventive concept, only by separation of the waste developer receptacle 80, the developing member 34 and image carrier 32 are automatically spaced apart from each other. Therefore, a case in which the developing unit 33 and the photographing unit 31 are separated in a state in which the developing member 34 and the image carrier 32 are in contact with each other may not occur.

Also, with a maintenance method of an image forming apparatus 1 according to an exemplary embodiment of the present general inventive concept, only when the lever member 160 is in the contact position, the waste developer receptacle 80 can be mounted in the main body frame 10. Therefore, to operate the image forming apparatus 1 in a state in which the developing member 34 is not in contact with the image carrier 32 may be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body frame;

an image forming unit disposed in the main body frame and comprising an image carrier and a developing member;

a gap control unit selectively operable to cause the image carrier and the developing member to be in contact with, or to be spaced apart from, each other;

a lever member movable to a first position to thereby selectively operate the gap control unit to cause the image carrier and the developing member to be in contact with each other, and to a second position to thereby selectively operate the gap control unit to cause the image carrier and the developing member to be spaced apart from each other; and a waste developer receptacle provided with a lever member receiving groove, the waste developer receptacle detachably positionable in the main body frame and configured so that, while the lever member is in the first position and the waste developer receptacle is being positioned in the main body frame, the lever member is received in the lever member receiving groove, wherein if the waste developer receptacle is removed from the main body frame, the image carrier and the developing member are spaced apart from each other by the gap control unit.

2. The image forming apparatus of claim 1, wherein:

the lever member receiving groove of the waste developer receptacle comprises a lever member operating rib to press the lever member towards the second position.

3. The image forming apparatus of claim 2, wherein:

the lever member receiving groove of the waste developer receptacle further comprises a stopper to limit rotation of the lever member by the lever member operating rib.

4. The image forming apparatus of claim 2, wherein:

the lever member operating rib comprises an inclined surface to be in contact with the lever member.

5. The image forming apparatus of claim 1, wherein:

the main body frame comprises a mounting groove that is formed in a shape corresponding to the waste developer receptacle and in which the waste developer receptacle is detachably positionable; and the lever member is rotatably disposed on a bottom surface of the mounting groove.

6. The image forming apparatus of claim 5, wherein:

when the lever member is moved to the second position, the waste developer receptacle is not mounted in the mounting groove.

7. The image forming apparatus of claim 1, wherein:

the lever member is formed in an L-shape;

the lever member receiving groove of the waste developer receptacle comprises a vertical groove and a horizontal groove that are formed in the L-shape to accommodate the lever member inserted therein; and a lever member operating rib configured to press the lever member towards the second position is provided on a top surface of the horizontal groove, and a bottom surface of the horizontal groove is configured to limit rotation of the lever member by the lever member operating rib.

8. The image forming apparatus of claim 1, wherein:

the gap control unit is a link structure having at least two links.

9. The image forming apparatus of claim 1, wherein:

the image forming unit comprises:

a developing unit including the developing member; and a photographing unit that is hinge-connected to the developing unit and includes the image carrier;

the gap control unit comprises:

a pressing member disposed in the main body frame so that the pressing member can linearly move with respect to a lower portion of the developing unit;

a link member having one end connected to the pressing member;

a crank arm rotatably connected to other end of the link member;

an elastic member disposed around the link member to elastically support the pressing member; and a rotation shaft that is connected to the crank arm, is rotatably disposed in the main body frame, and has one end being protruded in the mounting groove; and the lever member is connected to the one end of the rotation shaft that is protruded in the mounting groove.

10. The image forming apparatus of claim 9, wherein:

the pressing member comprises an elongate groove that is formed in a direction parallel to a moving direction of the pressing member; and a guide projection is formed at one end of the link member, is inserted in the elongate groove, and can be moved inside the elongate groove.

11. The image forming apparatus of claim 9, wherein:

if the lever member is moved to the first position, the elastic member pushes the pressing member to allow the developing unit to be rotated by a predetermined angle so that the developing member is brought into contact with the image carrier; and if the lever member is moved to the second position, a force with which the elastic member pushes the pressing member is removed to allow the developing unit to be returned to an original position so that the developing member is spaced apart from the image carrier.

12. The image forming apparatus of claim 9, wherein:

when the link member and the crank arm make a straight line, the elastic member is compressed to a maximum.

13. The image forming apparatus of claim 9, wherein:

a first stopper is disposed in the main body frame and is configured to limit rotational motion of the crank arm; and when the crank arm is in contact with the first stopper, the pressing member presses the developing unit by the elastic force of the elastic member so that the developing member is brought into contact with the image carrier.

14. The image forming apparatus of claim 13, wherein:

when the lever member is in contact with a stopper of the waste developer receptacle, an angle between the crank arm and the link member is the same as or similar to an angle between the crank arm and the link member when the crank arm is in contact with the first stopper.

15. A maintenance method of an image forming apparatus, the method comprising:

separating a waste developer receptacle from a main body frame;

allowing, while the waste developer receptacle is separated, a lever member to be automatically moved to a first position to cause a developing member of a developing unit to be spaced apart from an image carrier of a photographing unit;

allowing the lever member to be moved to a second position to cause the developing member of the developing unit to be in contact with the image carrier of the photographing unit;

mounting the waste developer receptacle in the main body frame in order for the lever member in the second position to be inserted into a lever member receiving groove of the waste developer receptacle; and allowing, while the waste developer receptacle is mounted in the main body frame, a lever member operating rib of the lever member receiving groove to press the lever member towards the first position so that the lever member is brought into contact with a stopper of the lever member receiving groove.

16. The maintenance method of claim 15, wherein when the lever member is in contact with the stopper of the lever member receiving groove, a force that is applied to the developing unit is the same as or similar to a force that is applied to the developing unit when the lever member is placed in the second position.

17. The maintenance method of claim 15, wherein:

if the waste developer receptacle is separated from the main body frame, the lever member is moved to the first position by an elastic force of a gap control unit pressing the developing unit so that the developing member of the developing unit is spaced apart from the image carrier of the photographing unit.

18. An image forming apparatus, comprising:

a gap control unit disposed to control a gap between an image carrier and a developing member, the gap control unit being configured to narrow the gap when disposed in a first position; and a lever member disposed to move the gap control unit to a second position opposite to the first position with respect to a reference line, according to a force transmitted from an external unit to the lever member when the external unit is installed in the image forming apparatus.

19. The image forming apparatus of claim 18, wherein the external unit is a waste developer receptacle.

20. The image forming apparatus of claim 18, wherein the gap control unit comprises an arm forming an angle with the reference line according to the position of the gap control unit.

21. The image forming apparatus of claim 20, wherein the angle formed by the arm with the reference line controls the gap between the image carrier and the developing member.

22. The image forming apparatus of claim 21, wherein the absolute value of the angle formed by the arm with the reference line when the gap control unit is in the first position is approximately equal to the absolute value of the angle formed by the arm with the reference line when the gap control unit is in the second position.

23. The image forming apparatus of claim 20, wherein the gap control unit further comprises a link to form an angle with the arm, the angle between the arm and the link varying according to a movement of the lever member.

24. The image forming apparatus of claim 23, wherein the angle between the arm and the link controls the gap between the image carrier and the developing member.

25. The image forming apparatus of claim 23, wherein the absolute value of the angle between the arm and the link when the gap control unit is in the first position is approximately equal to the absolute value of the angle between the arm and the link when the gap control unit is in the second position.

26. The image forming apparatus of claim 23, wherein the link comprises an elastic member to move the gap control unit according to the movement of the lever member.

27. The image forming apparatus of claim 18, wherein the gap control unit further comprises a shaft connected to the lever member at one end of the gap control unit, and a distance between the shaft and an opposite end of the gap control unit controls the gap between the image carrier and the developing member.

28. The image forming apparatus of claim 18, wherein:

when the external unit is removed from the image forming apparatus, the gap control unit moves in a direction towards a third position; and the gap control unit is configured to widen the gap between the image carrier and the developing member when the gap control unit is moved towards the third position.

29. The image forming apparatus of claim 28, wherein the lever moves in the same direction when the gap control unit moves from the first position to the second position as when the gap control unit moves from the second position to the third position.

30. A maintenance method of an image forming apparatus, the method comprising:

narrowing a gap between an image carrier and a developing member when a gap control is disposed in a first position; and using a lever member to move the gap control unit to a second position opposite to the first position with respect to a reference line, according to a force transmitted from an external unit to the lever member when the external unit is installed in the image forming apparatus.

31. The maintenance method of claim 30, wherein the lever member is formed in an L-shape.

* * * * *